US005680782A

United States Patent [19]

Komatsu et al.

[11] Patent Number: 5,680,782

[45] Date of Patent: Oct. 28, 1997

[54] THEFT SURVEILLANCE CASE AND JIG FOR THEFT SURVEILLANCE CASE

[75] Inventors: Hiroaki Komatsu, Hasuda; Sumio Sakurada, Sendai, both of Japan

[73] Assignee: MG Co., Ltd., Japan

[21] Appl. No.: 566,790

[22] Filed: Dec. 4, 1995

[30] Foreign Application Priority Data

Dec. 5, 1994 [JP] Japan ..... 6-300985

[51] Int. Cl.[6] ..... E05B 65/00

[52] U.S. Cl. ..... 70/54.1; 70/63; 70/19; 70/401; 206/1.5

[58] Field of Search ..... 70/398, 399, 395, 70/401, 57.1, 19, 63; 206/1.5

[56] References Cited

U.S. PATENT DOCUMENTS

| | | | |
|---|---|---|---|
| 4,048,050 | 9/1977 | Hillman | 206/1.5 |
| 4,126,224 | 11/1978 | Laauwe et al. | 206/1.5 |
| 4,219,116 | 8/1980 | Borkan | 206/1.5 |
| 4,561,544 | 12/1985 | Reeve | 206/1.5 |
| 4,589,549 | 5/1986 | Hehn | 206/1.5 |
| 4,819,797 | 4/1989 | Holmgren . | |
| 5,129,244 | 7/1992 | Wittman | 70/57.1 |
| 5,205,401 | 4/1993 | Weisburn et al. | 206/1.5 |
| 5,209,086 | 5/1993 | Brühwiler | 70/57.1 |
| 5,255,543 | 10/1993 | Wittman | 70/57.1 |
| 5,285,018 | 2/1994 | Weisburn | 206/1.5 |
| 5,289,914 | 3/1994 | Holmgren | 206/1.5 |
| 5,375,712 | 12/1994 | Weisburn | 206/1.5 |
| 5,385,235 | 1/1995 | Ikebe et al. | 206/1.5 |
| 5,390,515 | 2/1995 | Essick | 70/57.1 |
| 5,417,319 | 5/1995 | Chalberg et al. | 206/1.5 |
| 5,524,752 | 6/1996 | Mazzucchelli | 206/1.5 |

FOREIGN PATENT DOCUMENTS

| | | | |
|---|---|---|---|
| 045872 | 11/1991 | European Pat. Off. | 70/57.1 |
| 0461049 | 12/1991 | European Pat. Off. | 206/1.5 |
| 2628717 | 9/1989 | France | 206/1.5 |
| 9315294 | 8/1993 | WIPO | 70/57.1 |

*Primary Examiner*—Darnell M. Boucher
*Attorney, Agent, or Firm*—Merchant, Gould, Smith, Edell, Welter & Schmidt

[57] ABSTRACT

The invention provides a theft surveillance case having a stationary member (100) and hook-shaped locking portions (203, 204). Two projecting portion groups (121, 122; 123, 124) are formed in the stationary member (100) with a predetermined distance between them, so that they can lock a CD accommodating case (500) either at a fixing position where the CD accommodating case is clamped by pawl portions (105, 205) or at a position where the CD accommodating case can be disconnected. The distal end portions of the hook-shaped locking portions (203, 204), which are positioned and locked at either a position where they have ridden over the outer one of the two projecting portions of the projecting portion group (121, 122; 123, 124) or a position where they have ridden over the projecting portion at the deeper side, have substantially L-shaped sections and flat portions at their top portions. The distal end portions of the hook-shaped locking portions (203, 204) have a predetermined flexibility, so that they can ride over the projecting portions.

5 Claims, 4 Drawing Sheets

THEFT SURVEILLANCE CASE AND JIG FOR THEFT SURVEILLANCE CASE

BACKGROUND OF THE INVENTION

Field of the Invention

The present invention relates to a theft surveillance case and a jig for a theft surveillance case.

In recent years, antitheft systems to prevent thefts, e.g., shoplifting, at a retail store have been gradually introduced, not only in the U.S. but also in Japan. In an antitheft system, an antitheft seal, an antitheft tag, or the like is directly adhered and fixed to merchandise or the like at a retail store. Alternatively, an antitheft seal, an antitheft tag, or the like is accommodated in an exclusive accommodating case, and the exclusive accommodating case, including the antitheft seal, antitheft tag, or the like is attached to a merchandise.

In both cases, when someone tries to smuggle non-paid merchandise out of the store, a shoplifting preventing system (theft surveillance unit) provided in the vicinity of the sales counter entrance/exit detects the sensitive sticker or antitheft tag that comes close to it or passes by it, and informs the employee of the store of this fact by generating an alarm or the like.

When, however, the antitheft seal, antitheft tag, or the like is directly adhered to the merchandise, as this antitheft system prevails, customers become used to this system. Some customer removes or tears off the antitheft seal or tag adhered to the merchandise without permission, thereby disabling the system. Hence, this antitheft system sometimes cannot be used effectively.

Furthermore, since the seal or the like is directly adhered to the merchandise, if the merchandise is a compact disk (CD), a laser disk (LD), or the like having a metal deposition layer, or is made of a metal, the detection sensitivity is degraded due to the structure of the shoplifting preventing system. Then the shoplifting preventing system sometimes cannot detect the merchandise to which an antitheft seal is adhered, that passes by it.

In order to cope with these situations, in some shoplifting preventing system, the antitheft tag or the like is accommodated in an exclusive accommodating case that cannot be easily disconnected from the merchandise, and the accommodating case is hung from the merchandise. When the customer pays for the merchandise, this exclusive accommodating case is disconnected with a special disconnecting jig.

However, even with this system, sometimes the customer smuggles the merchandise by, e.g., cutting the hanging exclusive accommodating case.

SUMMARY OF THE INVENTION

The present invention has been made in order to solve the above problems, and has as its object to form a sensitive element of a theft surveillance unit and a case that accommodates the sensitive element such that they cannot be easily disconnected, and to provide a theft surveillance case that allows a predetermined distance between the sensitive element of the theft surveillance unit and a merchandise, that does not require the sensitive element to be fixed to a specific portion but allows the sensitive element to oscillate freely, and that can improve the detection precision of the antitheft system.

It is another object of the present invention to provide a theft surveillance case in which the respective members are integrated even after the theft surveillance case is disconnected, so that the theft surveillance case can be stored easily.

It is still another object of the present invention to provide a theft surveillance case that cannot be easily disconnected without an exclusive jig, so that a major antitheft effect can be obtained.

It is still another object of the present invention to provide a disconnecting jig that can easily disconnect the case and the merchandise from each other upon payment so that only the merchandise is handed to the customer, thus enabling repetitive use of the case and the sensitive element for further theft surveillance.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENT

A preferred embodiment of the present invention will be described in detail with reference to the accompanying drawings.

In the following description, the merchandise accommodated in the antitheft case is a compact disk (CD), and this CD is displayed on a display rack as it is accommodated in a merchandise packaging case (CD case). Note that the present invention can naturally be applied to any merchandise, e.g., a CD-ROM, accommodated in a merchandise accommodating case.

Figure 1A:
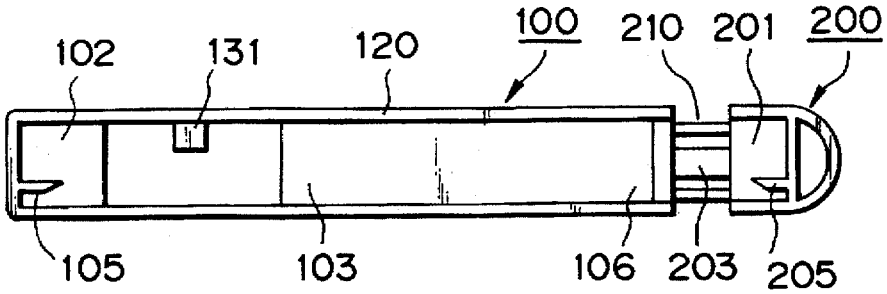
FIGS. 1A to 1C show an antitheft case according to an embodiment of the present invention.
Figure 1B:
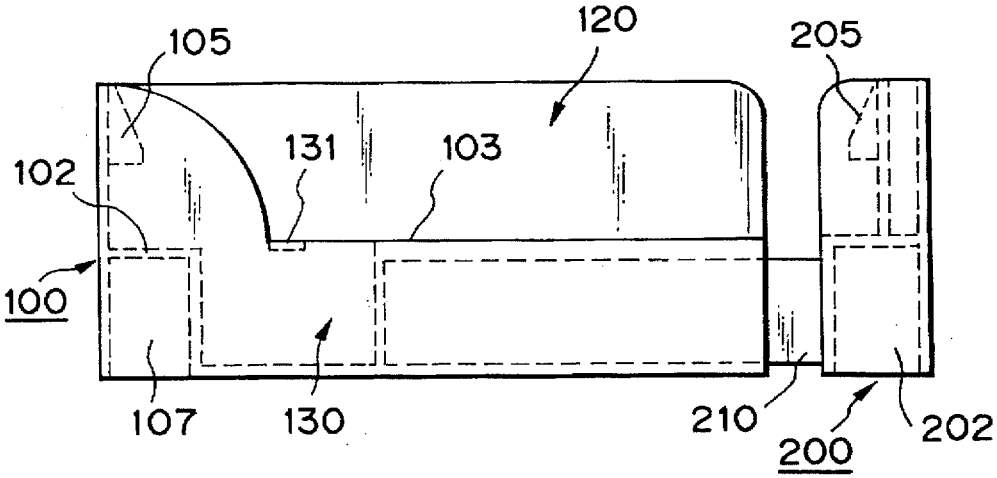
Figure 1C:
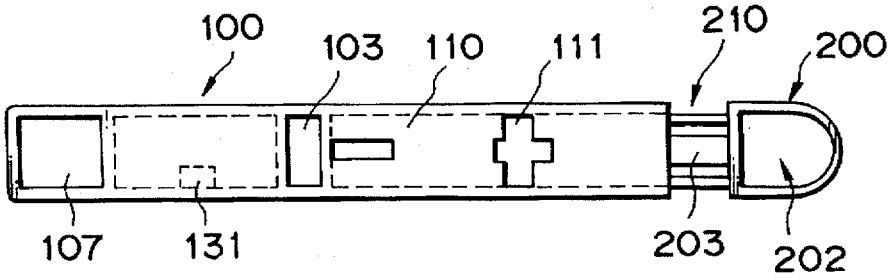

FIGS. 1A to 1C show a stationary case which accommodates an antitheft tag or the like according to the first embodiment of the present invention and which is integrally mounted on a CD accommodating case so that the CD case cannot be opened and the merchandise cannot be extracted. FIGS. 1A, 1B, and 1C show the top view, the front view, and the bottom view, respectively, of the stationary case.

Figure 2:
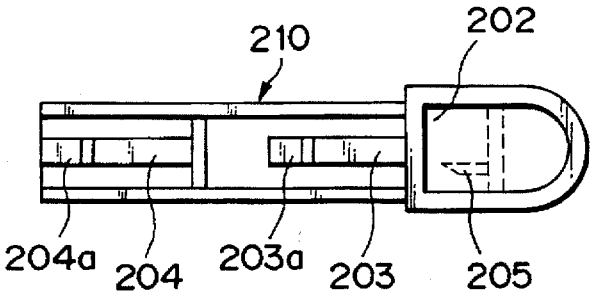
FIG. 2 shows the structure of the stationary case slidable member of the antitheft case of this embodiment.
Figure 3:
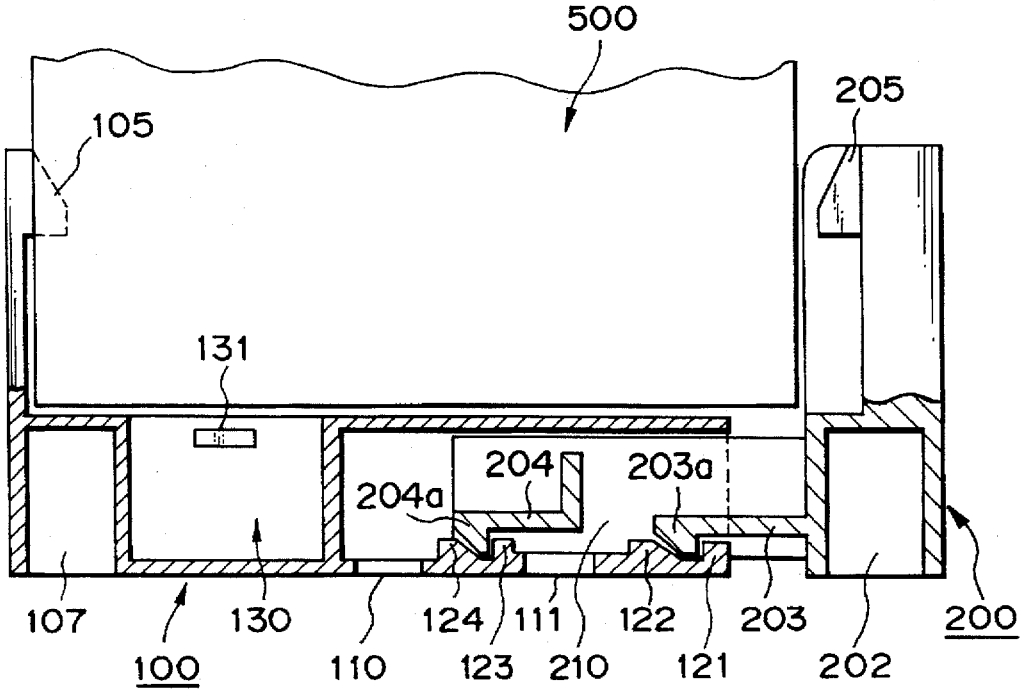
FIG. 3 shows the antitheft case of this embodiment placed in an unlocked position where a merchandise accommodating case can be disconnected.
Figure 4:
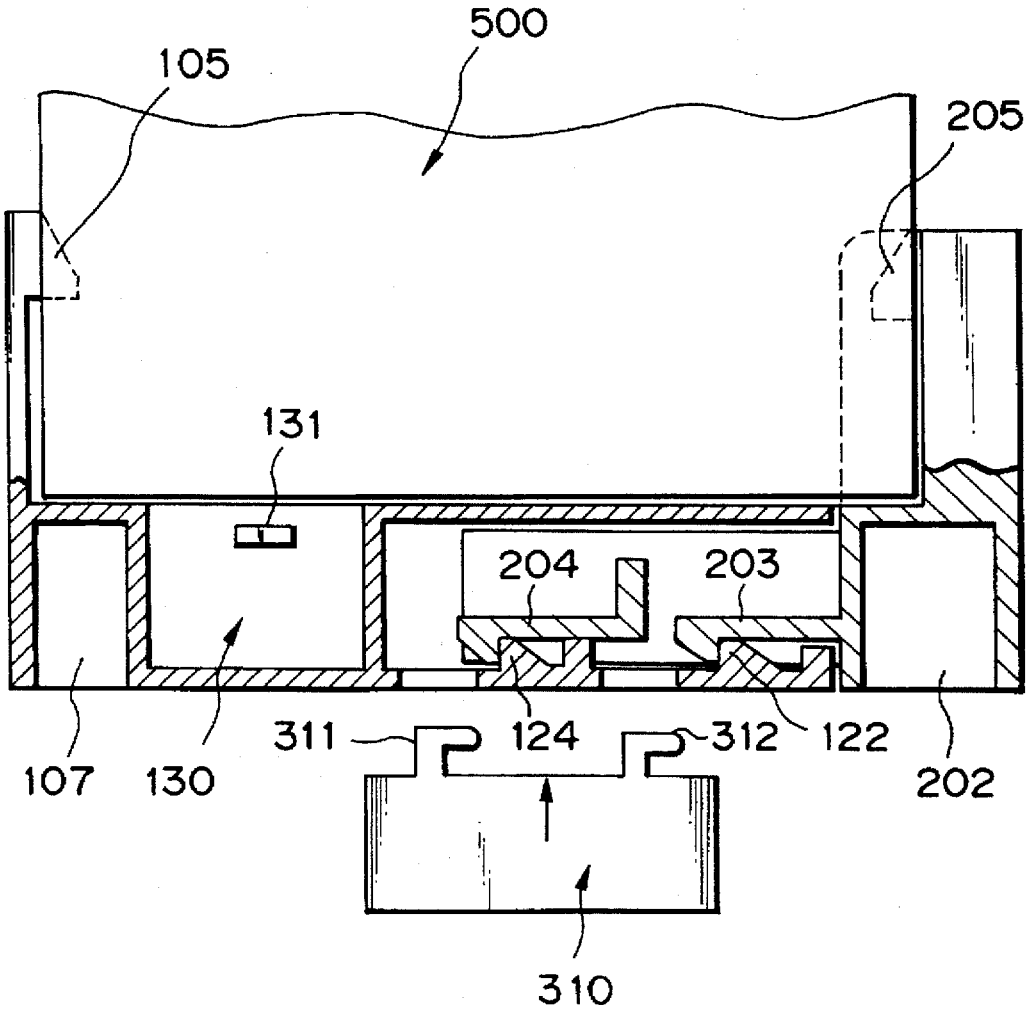
FIG. 4 shows the antitheft case of this embodiment placed in a locked position where it clamps and fixes the merchandise accommodating case.

FIG. 2 is a bottom view of a stationary case slidable member shown in FIGS. 1A to 1C, FIG. 3 is a schematic view showing the stationary case shown in FIGS. 1A to 1C before it is mounted on the CD case, and FIG. 4 is a schematic view showing the stationary case shown in FIGS. 1A to 1C after it is mounted on the CD case.

Referring to FIGS. 1 to 4, reference numeral 100 denotes a stationary case body; and 200, a stationary case slidable member. As will be described later, the stationary case slidable member 200 can be set in two states, i.e., the open state shown in FIG. 3 and the lock state shown in FIG. 4. In the lock state, a pawl portion 105 of the stationary case body 100 and a pawl portion 205 of the stationary case slidable member 200 are inserted into notched portions formed in the vicinities of the end portion of the opening/closing portion of the CD case to sandwich the CD case, so that the stationary case slidable member 200 is fixed to the CD case while it locks the CD case in the closed state.

When the stationary case body 100 is in the state as shown in FIGS. 1A to 1C, a CD case 500 is pressed onto the stationary case body 100 as shown in FIG. 3. In this state, the stationary case slidable member 200 is pushed toward the CD case 500, so that the stationary case body 100 is fixed to the CD case 500, as shown in FIG. 3.

The arrangements of the respective members will be described in detail.

In the stationary case body 100, reference numerals 102, 103, and 106 denote positioning portions; 105, a pawl portion; 107, a recessed portion; and 110 and 111, hole portions. The positioning portions 102, 103, and 106 come into contact with the opening end portion of the opening/closing portion of the CD case 500, thereby positioning the CD case 500. The pawl portion 105 is inserted in the notched portion formed in the side surface of the CD case 500, thereby fixing the CD case 500 not to open. The disconnecting members of an opener (a jig for disconnecting the CD accommodating case) serving as the opening key member (to be described later) of a stationary case are inserted in the hole portions 110 and 111 formed in the bottom portion of the stationary case body 100.

Referring to FIG. 3, reference numeral 121 denotes a first anti-removal projecting portion having a substantially square section; 122, a first fixing projecting portion having a substantially L-shaped section; 123, a second anti-removal projecting portion having a substantially square section; 124, a second fixing projecting portion having a substantially L-shaped section; 130, a tag accommodating portion; and 131, a tag-locking projecting portion. The projecting portion 121 prevents a first hook portion 203 of the stationary case slidable member 200 from being removed. The projecting portion 122 has a flat portion on its top portion and maintains the first hook portion 203 in the stationary state. The projecting portion 123 prevents a second hook portion 204 of the stationary case slidable member 200 from being removed. The projecting portion 124 has a flat portion in its top portion and maintains the second hook portion 204 in the stationary state. The tag accommodating portion 130 accommodates, e.g., a vibration type antitheft tag. The tag-locking projecting portion 131 also serves as a positioning portion which comes into contact with the end portion of the opening/closing portion of the CD case 500, thereby positioning the CD case 500. When accommodating the antitheft tag in the tag accommodating portion 130, one side of the antitheft tag is set in the tag accommodating portion 130, and the antitheft tag is placed in the tag accommodating portion 130 by slightly bending it such that it rides over the tag-locking projecting portion 131.

A side wall having a predetermined height is formed on one side surface of the upper portion of the stationary case body 100 in order to position and hold the bottom portion of the CD case 500. Similarly, a partial side wall having a predetermined height is formed in the side nearer to the pawl portion 105 on the other side surface of the stationary case body 100. These two side walls prevent the lid of the CD case 500 from opening/closing, and can position the CD case 500 easily such that the pawl portion 105 enters the notched portion of the CD case 500.

In the stationary case slidable member 200, reference numeral 202 denotes a recessed portion; 203, a first hook portion; and 204, a second hook portion. The first hook portion 203 has, at its distal end portion, a first locking pawl portion 203*a* having a substantially L-shaped section and a flat portion at its top portion. The second hook portion 204 has, at its distal end portion, a second locking pawl portion 204*a* having a substantially L-shaped section and a flat portion at its top portion. The distal end portions of the hook portions 203 and 204 have predetermined flexibility. Upon application of a pressure, the first and second locking pawl portions 203*a* and 204*a* can ride over the projecting portions 121, 122, 123, and 124 of the stationary case body 100. Reference numeral 205 denotes a pawl portion; and 210, an accommodating portion in the stationary case. The pawl portion 205 is inserted in the notched hole portion formed in one side surface of the CD case 500, thereby fixing the CD case 500 not to open. The two outer side surfaces of the accommodating portion 210 contact the inner side surfaces of the lower portions of the positioning portions 104 and 106 of the stationary case body 100, so that the accommodating portion 210 slides to be positioned in the stationary case body 100.

How to use this embodiment having the above arrangement will be described. In this embodiment, the stationary case body 100 and the stationary case slidable member 200 are separate members. Prior to actually using the stationary case, the accommodating portion 210 of the stationary case slidable member 200 is inserted in the stationary case body 100, and the hook portions 203 and 204 are pushed into the stationary case body 100 over the projecting portions 121, 122, and 123. The state as shown in FIG. 3 is thus obtained. In this state, the first and second hook portions 203 and 204 are stably locked between the first anti-removal projecting portion 121 and the first fixing projecting portion 122, and between the second anti-removal projecting portion 123 and the second fixing projecting portion 124, respectively, so that the two members 100 and 200 may not separatable from each other.

In this state, the antitheft tag is accommodated in the tag accommodating portion 130 of the stationary case body 100 in accordance with the procedure described above. This accommodating operation may be performed when the stationary case slidable member 200 is separate from the stationary case body 100. To fix the stationary case of this embodiment to the CD case 500 serving as the merchandise accommodating case, as shown in FIG. 3, the stationary case is pressed against the CD case 500 such that the pawl portion 105 of the stationary case body 100 enters the notched portion in one side surface of the CD case 500. In this state, the stationary case slidable member 200 is pushed toward the CD case 500, thereby fixing the stationary case to the CD case 500, as shown in FIG. 4.

In the state shown in FIG. 4, the first and second locking pawl portions 203*a* and 204*a* are securely fixed with the first and second fixing projecting portions 122 and 124 at the bottom portion of the stationary case body 100. The end portions of the upper, lower, and two side surfaces of the CD case 500 are clamped and fixed by the upper portion of the positioning portion 102 at the end portion of the stationary case body 100 and an end portion 201 of the stationary case slidable member 200, so that the CD case 500 may not open and a CD in it may not be extracted. Also, since the pawl portions 105 and 205 are inserted in the notched portions of the side surfaces of the CD case 500, the CD case 500 is fixed so as not to be removed.

Furthermore, in this state, the pawl portions 105 and 205 are unseen from the side of the bottom surface of the stationary case body 100. Even if someone tries to move the stationary case slidable member 200 by simply inserting a rod or the like, the pawl portions 105 and 205 cannot be pushed upward.

Also, the antitheft tag is completely accommodated in the case, so that it may not be extracted easily. As the antitheft tag is not fixed to the merchandise or the case by adhesion or the like, it does not interfere with vibration. Thus, even if the sensitive is a vibration type antitheft tag, a decrease in sensitivity accompanying fixing the tag does not occur, so that a good sensing result can be obtained, thus providing a highly reliable system.

A method of disconnecting the stationary case of this embodiment which is fixed to the CD case 500 in the above manner, and an opener serving as a disconnecting jig will be described.

To disconnect the stationary case, a disconnecting member denoted by reference numeral 310 in FIG. 4 is prepared. The disconnecting member 310 has L-shaped (hook-shaped) projecting portions 311 and 312 set with a gap therebetween so that they correspond to the hole portions 110 and 111. The projecting portions 311 and 312 are inserted in the hole portions 110 and 111. When the projecting portions 311 and 312 are completely inserted in the hole portions 110 and 111, the end portions at the L-shaped distal end portions of the projecting portions 311 and 312 correspond to the inclined portions of the pawl portions 203*a* and 204*a* of the first and second hook portions 203 and 204, respectively. In this state, when the disconnecting member 310 is moved toward the stationary case slidable member 200 to move the stationary case slidable member 200 to the outer side, the pawl portions 203*a* and 204*a* ride over the first and second fixing projecting portions 122 and 124 and are stably locked between the first fixing projecting portion 122 and the first anti-removal projecting portion 121, and between the second fixing projecting portion 124 and the second anti-removal projecting portion 123, respectively. This state corresponds to the state shown in FIG. 3. Therefore, the CD case 500 can be disconnected easily.

The operation of the disconnecting member 310 described above requires a strong force. If only the disconnecting member 310 is prepared, the disconnecting operation is difficult. When the opener shown in FIG. 5 is fabricated and the stationary case and the CD case 500 are disconnected from each other by using the opener, the disconnecting operation can be performed very easily by a single operation.

The opener as a case disconnecting jig according to this embodiment will be described with reference to FIG. 5.

Figure 5:
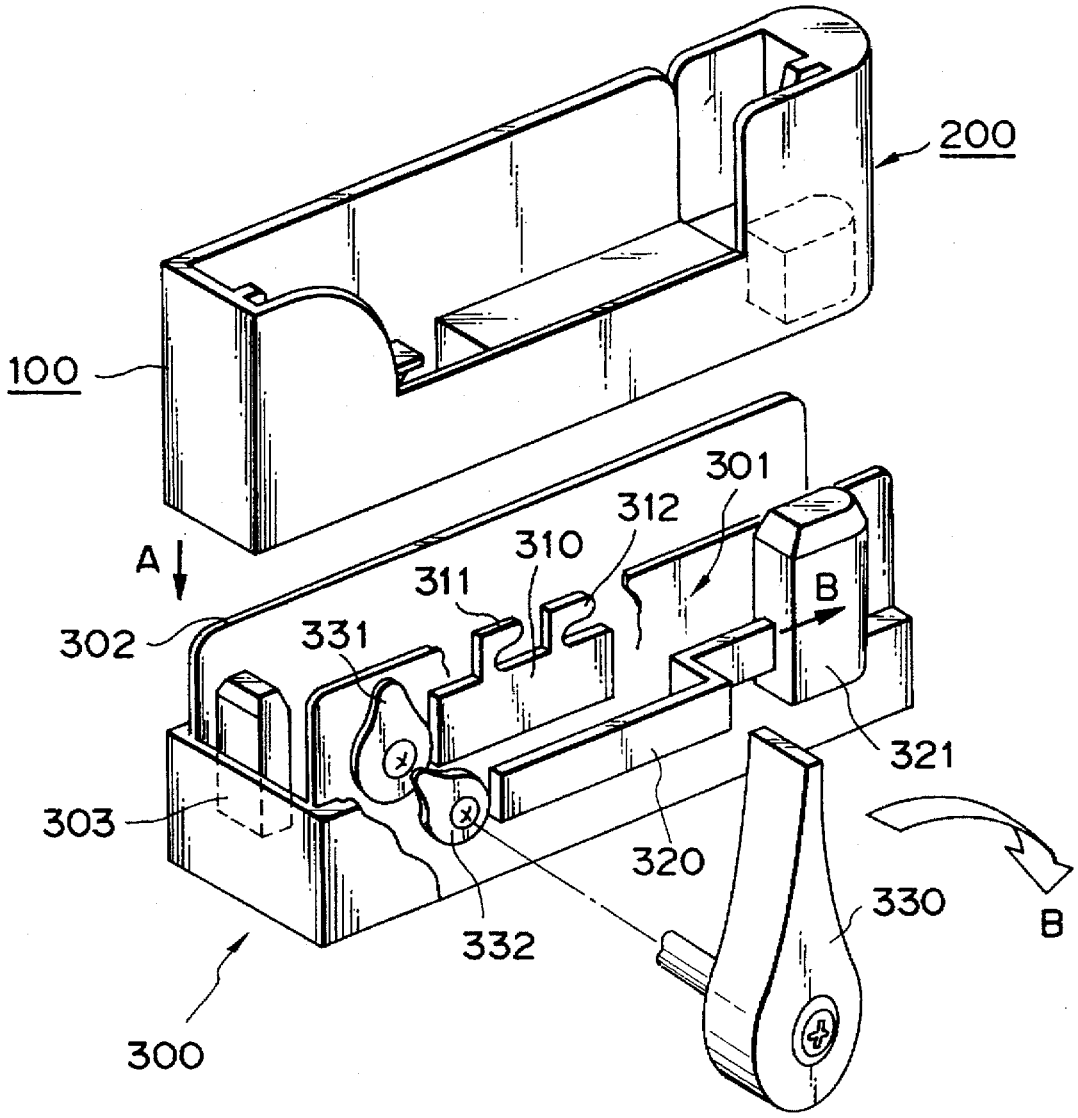
FIG. 5 shows a jig for an antitheft case of this embodiment.

As shown in FIG. 5, the opener has side panels 301 and 302, a stationary projecting segment 303, the disconnecting member 310, a movable projecting segment 321 movable in the direction of an arrow B in FIG. 5, a lever 330, and first and second cams 331 and 332. The side panels 301 and 302 position the CD case, on which the stationary case of this embodiment is mounted, by sandwiching it from the two side surfaces. The stationary projecting segment 303 is inserted in the recessed portion 107 of the stationary case body 100. The movable projecting segment 321 is inserted in the recessed portion 202 of the stationary case slidable member 200 and is fixed to a bar 320 engaging with the second cam 332. The lever 330 is axially mounted on the rotation shafts of the first and second cams 331 and 332. The first cam 331 moves the disconnecting member 310 in the direction of the arrow B for a predetermined amount. The second cam 332 moves the bar 320 in the direction of the arrow B after the first cam 331 is rotated for a predetermined amount or more and the disconnecting member 310 pushes up the pawl portions 203*a* and 204*a* over the top positions of the projecting portions 122 and 124. The disconnecting member 310 and the movable projecting segment 321 are constantly biased by springs or the like toward the cams 331 and 332 with a predetermined pressure. The disconnecting member 310 and the movable projecting segment 321 are pressed toward the cams 331 and 332 with a predetermined pressure unless the lever 330 is rotated in the direction of the arrow B so that the cams 331 and 332 move the disconnecting member 310 or the movable projecting segment 321 in the direction indicated by the arrow B in FIG. 5.

In this non-operative state, the recessed portion 107 of the stationary case of the embodiment which is fixed to the CD case corresponds to the position of the stationary projecting segment 303, and the recessed portion 202 of the stationary case slidable member 200 corresponds to the position of the movable projecting segment 321. In the operative state wherein the lever 330 is pulled down in the direction of the arrow B, the stationary case slidable member 200 of the stationary case shown in FIG. 3 slides such that the movable projecting segment 321 corresponds to the position of the recessed portion 202, where the CD case 500 can be disconnected.

An operation of disconnecting the stationary case of this embodiment, which is fixed to an actual CD case, from the CD case by using an opener 300 having the above arrangement will be described. In the non-operative state, the lever 330 of the opener 300 is upright. The stationary case fixed to the CD case is sufficiently inserted between the side panels 301 and 302 of the opener 300, as indicated by an arrow A in FIG. 5, such that the recessed portions 107 and 202 fit with the projecting segments 303 and 321, respectively. When the stationary case is inserted into the opener 300, the projecting portions 311 and 312 of the disconnecting member 310 are inserted and positioned in the hole portions 110 and 111 in the bottom surface of the stationary case body 100, and the end portions of the L-shaped distal end portions of the projecting portions 311 and 312 correspond to the inclined portions of the pawl portions 203*a* and 204*a* of the first and second hook portions 203 and 204, respectively.

In this state, when the lever 330 is pulled down, the cams 331 and 332 start rotation. First, the cam 331 moves the disconnecting member 310 toward the stationary case slidable member 200. The projecting portions 311 and 312 enter between the pawl portions 203*a* and 204*a* and the bottom surface of the stationary case body 100, and push up the pawl portions 203*a* and 204*a* to positions where they can ride over the first and second fixing projecting portions 122 and 124, respectively.

When the lever 330 is further pulled down, the cam 332 pushes the bar 320, and accordingly the movable projecting segment 321 moves in the direction of the arrow. As a result, the stationary case slidable member 200 accommodating the movable projecting segment 321 also moves in the direction of the arrow, and the pawl portions 203*a* and 204*a* ride over the first and second fixing projecting portions 122 and 124 and are stably locked between the first fixing projecting portion 122 and the first anti-removal projecting portion 121, and between the second fixing projecting portion 124 and the second anti-removal projecting portion 123, respectively. This corresponds to the state shown in FIG. 3. The CD case 500 can be disconnected easily in this state.

Furthermore, even after the CD case is disconnected, the stationary case body 100 and the stationary case slidable member 200 of this embodiment are not separated apart but are maintained in the integral state. If the members are separated apart, an inconvenience in storage occurs. However, such a problem does not occur.

When this opener 300 is used, the stationary case can be disconnected easily. In addition, when disconnecting the stationary case, a plurality of operations, i.e., an operation of the disconnecting member 310 and an operation of the stationary case slidable member 200, must be performed simultaneously in an interlocking manner. Hence, it is difficult to disconnect the stationary case without using this jig and smuggling a non-paid merchandise without being detected by the antitheft system can be prevented.

Furthermore, the stationary case of this embodiment locks the cover of the CD case not to open. Hence, it can prevent a case wherein only the CD is extracted from the CD case and smuggled, thus preventing thefts of merchandise more reliably. As the hook portions 203 and 204 are located at position unseen from the bottom surface, it is almost impossible to unlock the hook portions 203 and 204 with a rod or the like from the outside. A gap of a predetermined distance can be kept between the merchandise and the antitheft tag or the like. Therefore, even if the merchandise is made of a metal, a predetermined space can be kept around the antitheft tag, and a radio wave or magnetic wave emitted from the theft surveillance unit reliably passes through the antitheft tag. Even if the antitheft tag is of a vibration type, the vibration of the tag is not interfered with. Thus, a decrease in sensitivity of the theft surveillance unit can be prevented, and an antitheft tag or the like that passes by can be reliably detected.

A merchandise is accommodated in the above CD case to which the stationary case described above is fixed, and the CD case is displayed at a place where it can be reached by the customer. When the customer wishes to take this merchandise home or purchase it, he brings it to the cashier. Then, the cashier can disconnect the stationary case accommodating the antitheft tag or the like with the opener and hand the merchandise in the CD case to the customer. If an antitheft unit is installed outside the cashier, no antitheft tag or the like should pass by the theft surveillance unit. If the customer does not bring the merchandise to the cashier, the merchandise fixed with a stationary case passes by the place where the theft surveillance unit is installed, and an attempted theft can be detected.

As has been described above, according to the present invention, the sensitive element of a theft surveillance unit and the case of the sensitive element are formed such that they cannot be disconnected easily. A predetermined distance can be set between the sensitive element of the theft surveillance unit and the merchandise. The sensitive element need not be fixed to a specific portion but can be vibrated freely, thereby increasing the detection precision of the sensitive element.

Only the merchandise will be handed to the customer upon payment, so that the case and the sensitive element can be used repeatedly.

The antitheft tag or the like and its case are integrated. Hence, storage of the antitheft tag, its case, and the like is easy. As the antitheft tag or the like and its case cannot be disconnected easily without using an exclusive jig, a large antitheft effect can be obtained.

As many apparently widely different embodiments of the present invention can be made without departing from the spirit and scope thereof, it is to be understood that the invention is not limited to the specific embodiments thereof except as defined in the appended claims.

What is claimed is:

1. A theft surveillance case for fixing to a merchandise accommodating case (500) having an end portion and oppositely positioned first and second side surfaces, said theft surveillance case comprising a first and a second member for clamping said merchandise accommodating case (500) (100, 200), wherein said first member (100) has a clamp portion for clamping the first side surface of said merchandise accommodating case (500), positioning portions (102, 103) for forming surfaces against which the end portion of said merchandise accommodating case (500) is abutted and positioned, a sensitive element accommodating portion (130) capable of holding, in a storing state, a sensitive element that can be sensed by a theft surveillance unit under said positioning portions (102, 103), and a locking portion for accommodating part of said second member (200) and formed with at least two projecting portions (121, 122; 123, 124) with a predetermined gap therebetween, so as to be able to lock said second member (200) at either a first position where said merchandise accommodating case (500) is clamped and fixed or a second position where said merchandise accommodating case (500) can be disconnected, and said second member (200) has a clamp portion for clamping the second side surface of said merchandise accommodating case (500), and at least one engaging means (203; 204) having a distal end portion disposed in said first member (100), said distal end portion locking said second member (200) at the second position, where said merchandise accommodating case (500) can be disconnected, upon being located between said two projecting portions (121, 122; 123, 124) of said locking portion, and said distal end portion being locked at the first position, where said merchandise accommodating case (500) is clamped and fixed, upon being located deeper than said two projecting portions, the second member also including jig receiving holes for providing access to the at least one engaging means: and wherein, a jig (310) having L-shaped projections (311, 312) must be inserted into the jig receiving holes formed in the first member and moved in a lateral direction to disengage the at least one engaging means (203, 204) from the projecting portions.

2. The theft surveillance case according to claim 1, wherein said clamp portions of said first and second members have pawl portions (105, 205) that, when notched portions are formed in the first and second side surfaces of said merchandise accommodating case (500), enter the notched portions.

3. The theft surveillance case according to claim 1, wherein a recessed portion (107) is formed in a bottom surface of an end portion of said first member where said clamp portion is disposed, and a recessed portion is formed in a bottom surface of said clamp portion of said second member (200), and said engaging means includes a distal end portion of a hook shape having a substantially L-shaped section and a flat portion at a top portion thereof, said projecting portions of said locking portion having anti-removal projecting portions (121; 123) each with a substantially square section adapted to prevent removal of said distal end portion of said engaging means that locks said second member (200) at the second position where said merchandise accommodating case (500) can be disconnected, and fixing projecting portions (122, 124) each having a substantially L-shaped section and a flat portion at a top portion thereof, and each adapted to maintain, in a stationary state, said engaging means which is locked at the first position where said merchandise accommodating case is clamped and fixed.

4. The theft surveillance case of claim 1, where said jig comprises:

a stationary projecting segment adapted to be inserted in a recessed portion (107) of Said first member (100) of said theft surveillance case to maintain said first member in a stationary state, a movable projecting segment (321) adapted to be inserted in a recessed portion (202) of said second member to slide said second member from the first position where said merchandise accommodating case (500) is clamped and fixed to the second position where said merchandise accommodating case (500) can be disconnected, and a release mechanism which moves said L-shaped projections (311, 312) of said jig (310) laterally toward said engaging means while being kept inserted in the jig receiving holes defined by the first member, said release mechanism causes said distal end portion of said engaging means to ride on said L-shaped projecting portions (311, 312) such that said distal end portion of said engaging means rides over said projections (122, 124) of said first member (100), subsequently moves said movable projecting segment (321) to outside said merchandise accommodating case, and slides said second member from the first position where said merchandise accommodating case (500) is clamped and fixed to the second position where said merchandise accommodating case (500) can be disconnected.

5. A theft surveillance system for use with a merchandise accommodating case, the merchandise accommodating case including a first side opposite from a second side and an end portion extending between the first and second sides, the system including:

a first member including a first clamp portion for engaging the first side of the case and a base portion for engaging the end portion of the case, the base portion defining a slide opening and a jig receiving slot, the base portion also including first and second locking shoulders located within the slide opening;

a second member including a second clamp portion and a locking portion, the second clamp portion opposing the first clamp portion and being configured for engaging the second side of the case, the locking portion being slidably mounted in the slide opening of the base portion and including a hook structure configured for engaging the first and second locking shoulders, the second member being moveable between an open position in which the hook structure engages the first shoulder and the case is removable from the clamping portions, and a closed position in which the hook structure engages the second shoulder and the case is clamped by the clamping portions;

a sensing element that can be sensed by a theft surveillance unit, the sensing unit being mounted in one of the first and second members; and a jig having an L-shaped projection configured to be inserted in the jig receiving slot of the base portion, wherein the hook structure is disengaged from the first shoulder by inserting the L-shaped projection within the jig receiving slot, and then sliding the L-shaped projection laterally along the slot such that the L-shaped portion engages the hook structure.

* * * * *